US005938060A

United States Patent [19]

Rutland, Jr.

[11] Patent Number: 5,938,060

[45] Date of Patent: Aug. 17, 1999

[54] HOLDER FOR STACKABLE DRINKING CUPS

[76] Inventor: Matthew Rutland, Jr., 18485 Robson, Detroit, Mich. 48235

[21] Appl. No.: 08/996,163

[22] Filed: Dec. 22, 1997

[51] Int. Cl.[6] ..... B65D 1/02

[52] U.S. Cl. ..... 220/23.6; 220/23.86; 220/737

[58] Field of Search ..... 220/23.6, 23.83, 220/23.86, 737, 738, 512

[56] References Cited

U.S. PATENT DOCUMENTS

| | | | |
|---|---|---|---|
| 1,744,552 | 1/1930 | Katzinger | 220/23.6 |
| 2,805,017 | 9/1957 | Hill et al. | 220/737 |
| 3,964,629 | 6/1976 | McCabe | 220/23.86 |
| 4,694,961 | 9/1987 | Menendez | 220/23.6 X |
| 4,938,373 | 7/1990 | McKee | 220/23.86 |
| 5,333,751 | 8/1994 | Santucci, Sr. | 220/512 X |
| 5,456,360 | 10/1995 | Griffin | 220/23.86 X |

*Primary Examiner*—Steven Pollard

*Attorney, Agent, or Firm*—Reising, Ethington, Barnes, Kisselle, Learman & McCulloch, PC

[57] ABSTRACT

A holder for nestable, stackable drinking cups comprises a tray having openings for receiving the cups in upright position such that they may be filled with liquid. A retainer on the tray which is substantially identical in form to the drinking cups is adapted to receive and support the lowermost cup of a stack of nested cups. The tray is supported in a pan in spaced, parallel relation above the bottom wall of the pan.

3 Claims, 1 Drawing Sheet

HOLDER FOR STACKABLE DRINKING CUPS

FIELD OF INVENTION

This invention relates generally to holders for drinking cups and more particularly to a holder adapted to support cups upright so that they may be filled with liquid, and also having a retainer for empty cups.

BACKGROUND AND SUMMARY OF THE INVENTION

Drinking cups or glasses are often carried on a tray to serve drinks to guests at a party or other large gathering. However, a ready and convenient supply of fresh drinking cups and some means of dealing with empty drinking cups can be a problem.

In accordance with the present invention, a holder is provided comprising a tray having means for supporting the drinking cups in an upright position, such that they may be filled with liquid, and including means for supporting empty drinking cups on the tray.

The tray is especially adapted for use with nestable drinking cups, and preferably includes a retainer for supporting a stack of empty, nested drinking cups.

Preferably, the retainer is tapered and substantially identical in form to the drinking cups and is secured to the tray in inverted position to receive the lowermost cup of an inverted stack of nested cups.

For convenience, the tray is supported in a pan with means for supporting the tray above the bottom wall of the pan so that spilled liquid will be contained in the pan.

One object of the invention is to provide a holder for drinking cups having the foregoing features and capabilities.

Another object is to provide a holder for drinking cups which is composed of a relatively few simple parts, is rugged and durable in use, and can be inexpensively manufactured and assembled.

These and other objects, features and advantages of the invention will become more apparent as the following description proceeds, especially when considered with the accompanying drawings.

DETAILED DESCRIPTION OF THE PREFERRED EMBODIMENT

Figure 1:
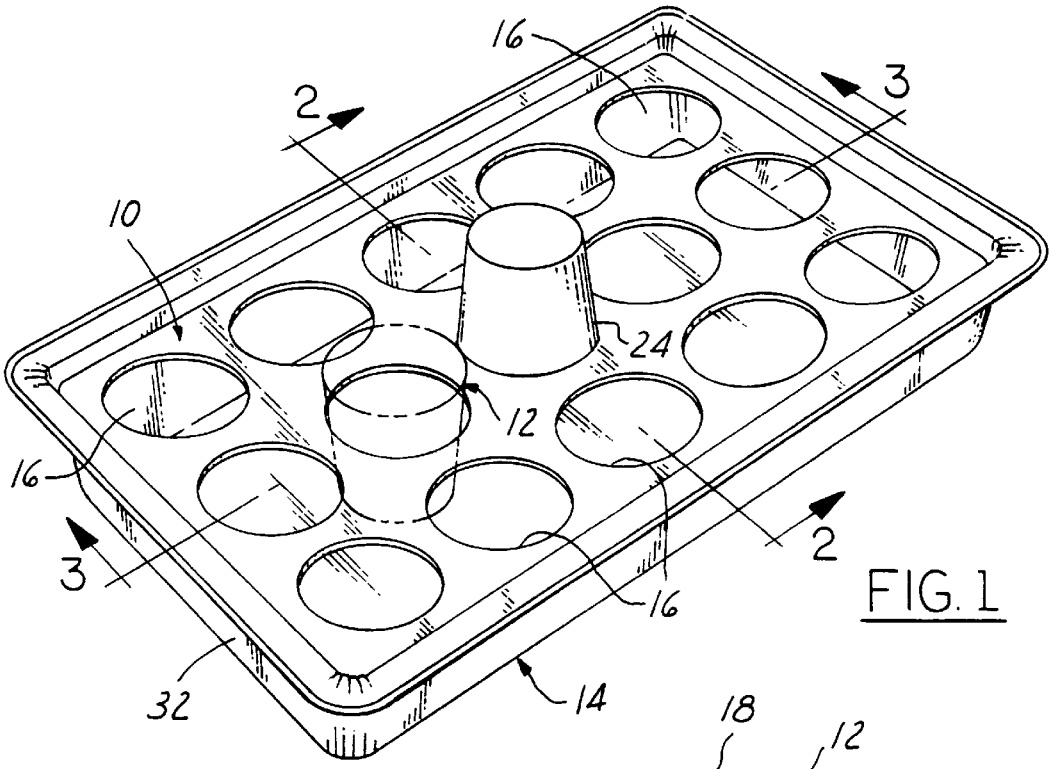
FIG. 1 is a perspective view of a holder for drinking cups constructed in accordance with the invention.
Figure 2:
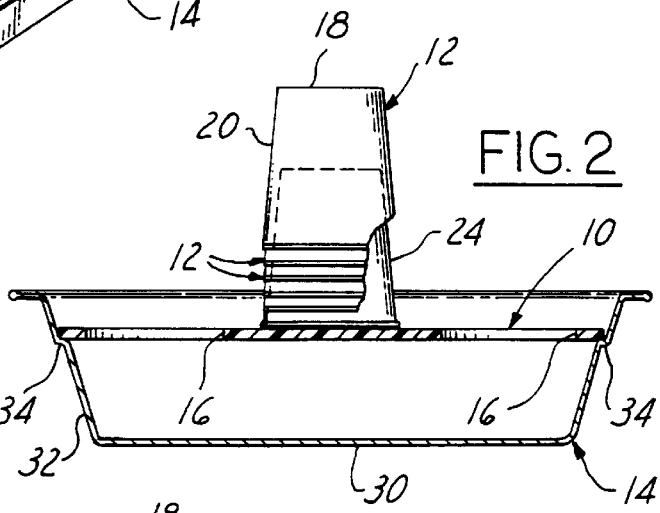
FIG. 2 is a sectional view taken on the line 2—2 in FIG. 1.
Figure 4:
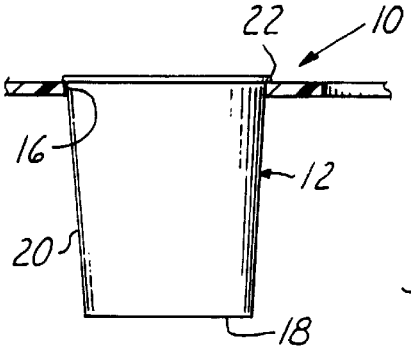
FIG. 4 is a fragmentary view, partly in section, showing a cup suspended in an opening in the tray.
Figure 3:
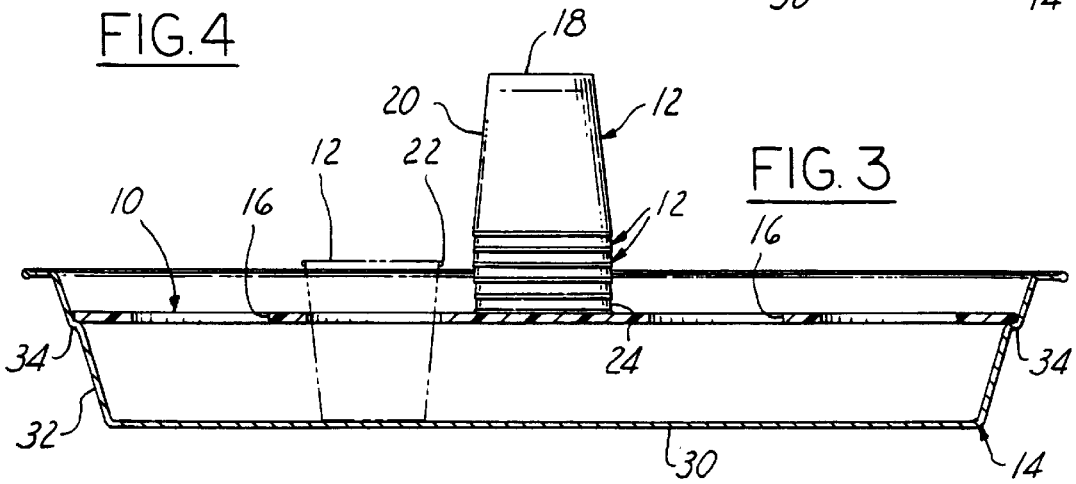
FIG. 3 is a sectional view taken on the line 3—3 in FIG. 1.

Referring now more specifically to the drawings, a tray 10 for carrying cups 12 is shown supported in a pan 14.

The tray 10 is preferably a flat, rectangular, relatively rigid panel made of plastic or other suitable material. The tray has a plurality of recesses in the form of circular openings 16. The cups 12, sometimes referred to as glasses, fit in these openings. The cups are identical, each having a flat circular, closed bottom wall 18, an open circular top, and a frusto-conical side wall 20. The side wall 20 is tapered uniformly from top to bottom, that is, it is of gradually decreasing circular cross-section from top to bottom so that the cups will nest with one another. Each cup has a bead or ring 22 which projects laterally outwardly at the top.

The openings 16 are of a diameter which preferably is slightly greater than the maximum diameter of the side wall 20 of the cups, but slightly less than the maximum diameter of the bead 22 so that when cups are inserted in the openings 16, the beads 22 will rest on the portions of the tray surrounding the openings 16 to suspend the cups.

The tray has a cup retainer 24 on its top surface, preferably at the center of the tray. The retainer has the same size and shape as the cups, although it is inverted, that is, it tapers upwardly rather than downwardly. The retainer 24 may actually consist of one of the cups 12 secured to the top surface of the tray with its open end down and its bottom up. A nested stack of empty cups may thus be inverted and placed upon the retainer.

The pan 14 is a large receptacle having a rectangular bottom wall 30 and a peripheral side wall 32 extending upwardly from the bottom wall. The side wall is inclined upwardly and outwardly so that it is longer and wider at the top than at the bottom. The width of the tray corresponds to the width dimension of the pan taken at a level between its upper and lower edges. The lengthwise dimension of the tray corresponds to the length dimension of the pan taken at a level between its upper and lower edges. Preferably, the side wall 32 is formed with a peripheral ledge or shelf 34 to support the side and end portions of the tray 10 in a position such that the tray is parallel to and spaced an inch or two above the bottom wall of the pan. Any spills will be trapped in the bottom of the tray. Alternatively, the ledge or shelf 34 may be omitted in which case the tray will rest within the pan wedged against the side wall. The cups 12 in the openings 16 may rest on the bottom wall 30 of the pan.

When the pan is not used, the bead 22 at the top of each cup will suspend the cups 12 in the openings 16.

What is claimed is:

1. A holder for drinking cups which have an open top and a side wall that tapers from the open top to a closed bottom to permit nesting comprising a flat tray having a plurality of spaced-apart openings for individually receiving and supporting the drinking cups in an upright position such that the drinking cups may be filled with liquid, and means for supporting a stack of empty nested drinking cups on said tray, wherein said tray has a top surface, and said supporting means comprises a retainer on said top surface adapted to receive the lowermost cup of a stack of nested cups, and wherein said retainer is upwardly tapered and is substantially identical in form to said drinking cups and is secured to said tray in inverted position to receive the lowermost cup of an inverted stack of nested cups.

2. A holder as defined in claim 1, and further including a downwardly dished pan having a bottom wall and a peripheral side wall extending upwardly from said bottom wall, and means for supporting said tray in said pan in spaced, parallel relation to said bottom wall.

3. A holder for drinking cups which have an open top and a side wall that tapers from the open top to a closed bottom to permit nesting comprising a flat tray having a plurality of spaced-apart openings for individually receiving and supporting the drinking cups in an upright position such that the drinking cups may be filled with liquid, and means for supporting a stack of empty nested drinking cups on said tray, wherein said tray has a top surface, and said supporting means comprises a retainer projecting upwardly from said top surface and adapted to receive the lowermost cup of a stack of nested cups, and wherein said retainer has a tapered side wall and is substantially identical in form to said drinking cups and is secured to the top surface of said tray to receive the lowermost cup of a stack of nested cups.

* * * * *